US006459072B1

(12) United States Patent
Selmi et al.

(10) Patent No.: US 6,459,072 B1
(45) Date of Patent: Oct. 1, 2002

(54) GLOW PLUG FOR INTERNAL COMBUSTION ENGINES

(75) Inventors: Ilaria Selmi; Sandro Goretti; Roberto Rossi, all of Carpi (IT)

(73) Assignee: Federal-Mogul Ignition Srl, Milan (IT)

( * ) Notice: Subject to any disclaimer, the term of this patent is extended or adjusted under 35 U.S.C. 154(b) by 0 days.

(21) Appl. No.: 09/922,665

(22) Filed: Aug. 6, 2001

(30) Foreign Application Priority Data

Aug. 11, 2000 (EP) ..... 00830579

(51) Int. Cl.[7] ..... F23Q 7/00

(52) U.S. Cl. ..... 219/270; 123/145 A; 338/223; 219/544

(58) Field of Search ..... 219/270, 544; 123/145 A, 145 R; 338/223–225, 238

(56) References Cited

U.S. PATENT DOCUMENTS 4,200,077 A * 4/1980 Kauhl et al. ..... 123/145 A 4,281,451 A * 8/1981 Mann ..... 123/145 A

FOREIGN PATENT DOCUMENTS

| | | | |
|---|---|---|---|
| DE | 2637464 | | 2/1978 |
| EP | 989370 | | 3/2000 |
| JP | 57-12221 | * | 1/1982 |
| JP | 9112904 | | 5/1997 |

* cited by examiner

*Primary Examiner*—John A. Jeffery
(74) *Attorney, Agent, or Firm*—Reising, Ethington, Barnes, Kisselle, Learman & McCulloch, P.C.

(57) ABSTRACT

A glow plug for internal-combustion engines, comprising: a metal body (12); a metal sheath (24) having one closed end (26) and one open end (28); a terminal (30) extending through the open end (28) of the sheath (24); a conductive powder (34) set in electrical connection with one end (36) of the terminal (30) and with the sheath (24); and a layer (38) of insulating powder set between the aforesaid conductive powder (34) and the sheath (24) in an area between the closed end (26) of the sheath (24) and the end (36) of the terminal (30).

7 Claims, 1 Drawing Sheet

GLOW PLUG FOR INTERNAL COMBUSTION ENGINES

BACKGROUND OF THE INVENTION

The present invention relates to a glow plug for internal-combustion engines, the glow plug being known from the document DE-A-2637464. This document describes a plug comprising a metal shell with a longitudinal hole in which is housed a metal sheath having one end closed and containing a resistive heating element consisting of an SiC powder, which may also contain a metal powder or a powder of an electrically conductive metal oxide. An electrical terminal has one end that extends up to the vicinity of the closed end of the metal sheath and is inserted inside the resistive element consisting of conductive powders. The terminal is surrounded by an insulating powder set on top of the heating element.

SUMMARY OF THE INVENTION

Starting from the above state of the art, the purpose of the present invention is to provide a glow plug with a resistive heating element consisting of conductive powders which makes it possible to vary in a simple way the design value of the resistance of the conductive powders and to obtain a spatial distribution of the resistance inside the metal sheath that is adequate for achieving the desired thermoelectric characteristics, such as position of ignition point, pre-heating time, current absorption, and the like.

According to the present invention the above purpose is achieved by a glow plug having the characteristics that form the subject of the invention

BRIEF DESCRIPTION OF THE DRAWINGS

The present invention will now be described in detail with reference to the attached drawings, which are provided purely to furnish a non-limiting example, and in which.

DETAILED DESCRIPTION OF THE PREFERRED EMBODIMENT

Figure 1:
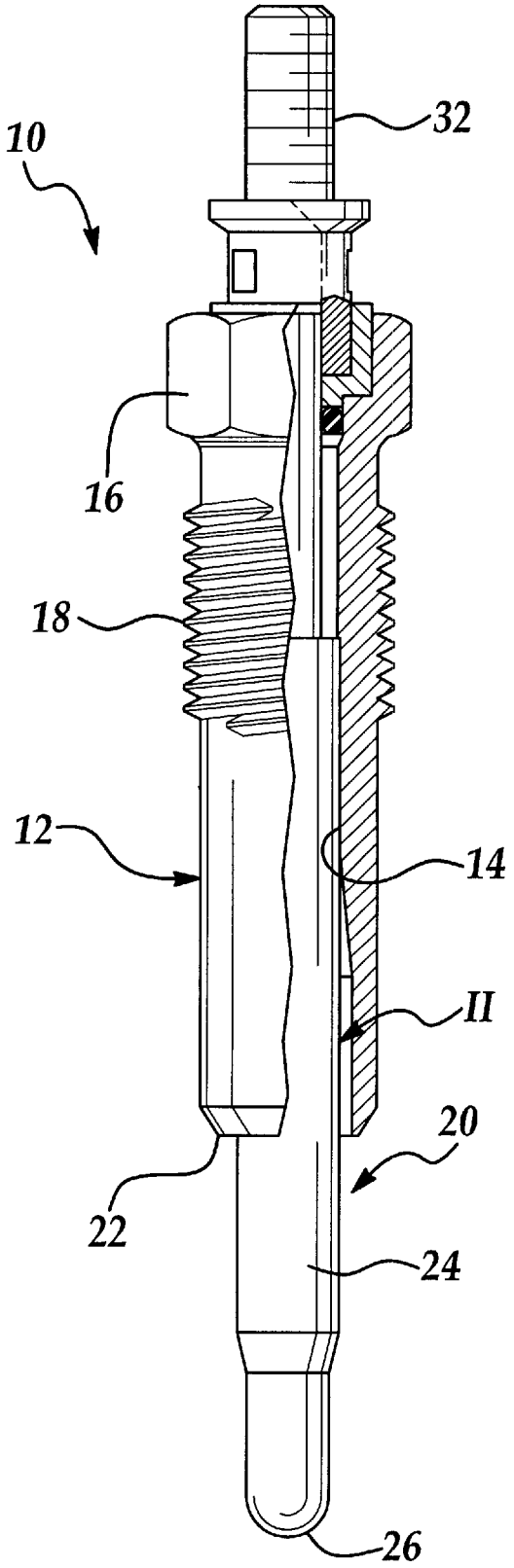
FIG. 1 is a partially sectioned side view of a glow plug according to the present invention.

With reference to the drawings, the number 10 designates a glow plug for internal-combustion engines. The glow plug 10 comprises a metal body 12 which has a through cavity 14 and is provided, on its external surface, with a hexagonal portion 16 designed to be engaged by a wrench, and with a threaded stretch 18 for fixing the plug 10 to the cylinder head (not illustrated) of an internal-combustion engine.

A heating element 20 is fixed inside the cavity 14 of the metal body 12 and protrudes from a first end 22 of the latter. The heating element 20 comprises a metal sheath 24 made of a material resistant to high temperatures and to the corrosion due to the combustion gases of an engine. The metal sheath 24 has one closed end 26, for example having a rounded shape, and one open end 28. A metal terminal 30 extends through the open end 28 of the sheath 24 and is electrically connected to an electrical connector 32 which is fixed with respect to the body 12 and is electrically insulated from the latter. A sealing ring 31 is set between the open end 28 of the sheath 24 and the external surface of the terminal 30.

Figure 2:
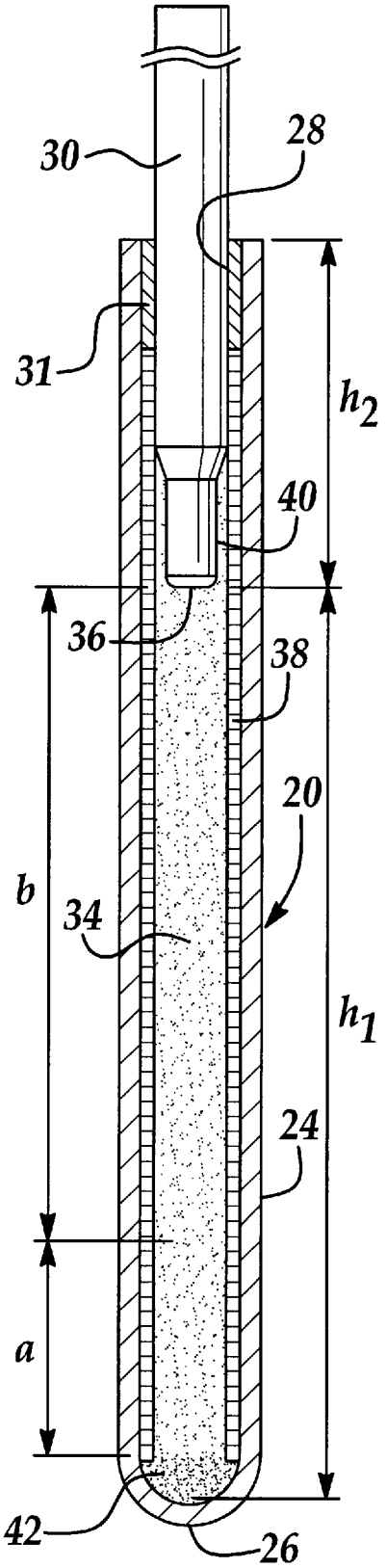
FIG. 2 is a schematic axial section at an enlarged scale of the part indicated by the arrow II in FIG. 1.

With reference to FIG. 2, the metal sheath 24, which is produced by means of a process in itself known, is filled with a resistive powder 34, preferably consisting of a mixture of two or more components.

Preferably, the resistive mixture 34 comprises an insulating powder (such as magnesium-oxide powder) intimately mixed with one or more conductive powders consisting, for example, of nickel powder, Hytemco®, Kanthal AF®, CF8®, $MoSi_2$ powder, etc. An appropriate selection of the grain sizes and relative concentrations of the conductive powders and insulating powders makes it possible to obtain a desired value of the electrical resistance and a desired spatial distribution of the resistance inside the metal sheath. In order to obtain a distribution of the electrical resistance along the longitudinal axis of the heating element 20, the terminal 30 is set in such a way that its end 36 inserted inside the sheath 24 is close to the open end 28 of the sheath 24. More precisely, the distance h1 between the end 36 of the terminal 30 and the closed end 26 of the sheath 24 is equal to or greater than the distance h2 between the end 36 of the terminal 30 and the open end 28 of the sheath 24. The spatial distribution of the value of the electrical resistance of the powder 34 is important for achieving the desired thermoelectric characteristics of the plug, in particular as regards to the position of the ignition point, pre-heating time, current absorption, etc.

According to a preferred embodiment of the present invention, along the longitudinal axis of the sheath 24 it is possible to alternate resistive mixtures having different chemical compositions. This characteristic enables simulation of the thermoelectric characteristics of various types of glow plugs currently available on the market: single-coil plugs, double-coil plugs, and self-limiting double-coil plugs (long post-heating, or LPH plugs). In particular, a stretch "a" of the sheath 24 can be filled with a mixture of powders that performs the function of as heating resistor, and a stretch "b" of the sheath 24 can be filled with a mixture of powders comprising powders of conductive elements with a positive temperature coefficient (PTC), which performs the function of a regulating resistive element.

The table below shows some of the possible combinations of materials that enable different characteristics of thermal behaviour of the plug to be obtained.

| Type of plug | Heating mixture | Regulating mixture |
|---|---|---|
| Single-coil | MgO + Kanthal AF<br>MgO + Ni<br>MgO + CF8 | |
| Double-coil | MgO + Kanthal AF | MgO + Nickel<br>MgO + Hytemco |
| LPH double-coil | MgO – Kanthal AF | MgO + CF8 |

The mixture of powders 34 is electrically insulated from the side wall of the sheath 24 by means of a tubular layer 38 of non-sintered insulating powder, such as magnesium oxide (MgO). The insulating layer 38 may be compacted and introduced into the sheath 24 before the powder mixture 34 is introduced.

The resistive mixture 34 may be inserted inside the sheath 24 in the form of a powder or in the form of a (non-sintered) compacted cylindrical tablet.

Electrical contact between the resistive mixture 34, the terminal 30, and the end 26 of the sheath 24 is ensured by adequate modulation of the concentration of conductive powders of the resistive mixture in the contact areas designated by 40 and 42. In these contact areas, the powder mixture has a resistive value negligible as compared to the overall resistive value of the heating element.

The present invention makes it possible to provide plugs with a regulating material which has a high temperature coefficient and which normally cannot be reduced to wires. A particularly advantageous aspect of the present invention lies in the fact that the powder mixtures 34 and 38 are not sintered beforehand, and this makes it possible to obtain compacting of the powders by means of a reduction in the diameter, i.e., swaging, of the sheath 24 via plastic deformation (hammering) after the sheath 24 has been filled and sealed. The technology for producing the plug according to the present invention does not require substantial modifications of the process for producing traditional plugs with coil-shaped heating elements, in that also in the process for producing traditional plugs a step is envisaged of introduction of a magnesium-oxide powder. The present invention does not entail limits of reliability linked to the dimensions of the sheath 24, and is therefore perfectly applicable in the case of sheaths of reduced dimensions (for example, with final diameter of 4 mm). For this type of application, the invention solves certain technological problems linked to the production of small-sized sheaths with coil-shaped resistive elements (problems of short-circuits between the coil and the sheath due to a poor alignment of the coil). The present invention does not entail any limit to the final resistive value that it is aimed to achieve. The resistive value can be modulated as desired by means of an appropriate selection of the grain size and concentration of the powders.

What is claimed is:

1. A glow plug for internal-combustion engines, comprising:

a metal body;

a metal sheath having one closed end and one open end;

a terminal extending through the open end of the sheath;

a conductive powder set in electrical connection with one end of the terminal and with the sheath; and a layer of insulating powder set between the aforesaid conductive powder and the sheath in an area between the closed end of the sheath and the aforesaid end of the terminal.

2. A glow plug according to claim 1, wherein the distance between the closed end of the sheath and the aforesaid end of the terminal is equal to or greater than the distance between the end of the terminal and the open end of the sheath.

3. A glow plug according to claim 1, wherein the aforesaid conductive powder is a mixture of two or more powders including at least one insulating powder and one conductive powder.

4. A glow plug according to claim 1, wherein the aforesaid conductive powder is divided into two sections containing mixtures of powders with different compositions.

5. A glow plug according to claim 2, wherein the aforesaid conductive powder comprises contact areas with a higher concentration of conductive powders located at the aforesaid end of the electrode and at the closed end of the sheath.

6. A glow plug according to claim 1, wherein the aforesaid layer of insulating powder consists of non-sintered compacted powder forming a tubular element which is inserted inside the sheath before introduction of the conductive powder.

7. A glow plug according to claim 1, wherein the aforesaid conductive powder is made in the form of a compacted and non-sintered cylindrical element.

* * * * *

UNITED STATES PATENT AND TRADEMARK OFFICE

CERTIFICATE OF CORRECTION

PATENT NO. : 6,459,072 B1 
DATED : October 1, 2002
INVENTOR(S) : Ilaria Selmi, Sandro Goretti and Roberto Rossi It is certified that error appears in the above-identified patent and that said Letters Patent is hereby corrected as shown below:

Title page,
Item [75], Inventors, delete "Ilaria Selmi; Sandro Goretti; Roberto Rossi, all of Carpi (IT)" and insert therefor -- Ilaria Selmi, Modena (IT); Sandro Goretti, Campogalliano Modena (IT); Roberto Rossi, Milano (IT) --.

Signed and Sealed this

First Day of April, 2003

JAMES E. ROGAN
*Director of the United States Patent and Trademark Office*